US009962617B2

(12) United States Patent
Zamperla

(10) Patent No.: US 9,962,617 B2
(45) Date of Patent: May 8, 2018

(54) AMUSEMENT DEVICE

(71) Applicant: ANTONIO ZAMPERLA S.P.A., Altavilla Vicentina (IT)

(72) Inventor: Alberto Zamperla, Altavilla Vicentina (IT)

(73) Assignee: ANTONIO ZAMPERLA S.P.A., Altavilla Vicentina (IT)

( * ) Notice: Subject to any disclaimer, the term of this patent is extended or adjusted under 35 U.S.C. 154(b) by 57 days.

(21) Appl. No.: 14/916,427

(22) PCT Filed: Sep. 19, 2014

(86) PCT No.: PCT/EP2014/070058
§ 371 (c)(1),
(2) Date: Mar. 3, 2016

(87) PCT Pub. No.: WO2015/040195
PCT Pub. Date: Mar. 26, 2015

(65) Prior Publication Data

US 2016/0220910 A1 Aug. 4, 2016

(30) Foreign Application Priority Data

Sep. 20, 2013 (EP) ..... 13185304

(51) Int. Cl.
*A63G 1/24* (2006.01)
*A63G 1/28* (2006.01)
*A63G 7/00* (2006.01)

(52) U.S. Cl.
CPC ..... *A63G 1/24* (2013.01); *A63G 1/28* (2013.01); *A63G 7/00* (2013.01)

(58) Field of Classification Search
CPC ... A63G 1/24; A63G 1/26; A63G 1/28; A63G 7/00
(Continued)

(56) References Cited

U.S. PATENT DOCUMENTS 1,527,893 A * 2/1925 Mangels ..... A63G 1/08 104/53
1,745,719 A 2/1930 Sellner
(Continued)

FOREIGN PATENT DOCUMENTS

BE 370 485 5/1930
EP 0 115 355 8/1984
(Continued)

OTHER PUBLICATIONS

International Preliminary Report on Patentability issued in PCT/EP2014/070058, dated Mar. 22, 2016.
(Continued)

*Primary Examiner* — Zachary L Kuhfuss
(74) *Attorney, Agent, or Firm* — Hunton Andrews Kurth LLP

(57) ABSTRACT

Amusement device (1) comprising a platform (2) riding on a track (3), said platform being provided with at least one arm (4), moveably connected to said platform, to rotate about a pivot (7) with respect to said platform, from a first position (P1) to at least one second position (P2), at least when a centrifugal force acts on said arm, and a compartment (5) for housing one or more passengers, integral with or connected to said at least one moveable arm, characterized in that said platform comprises means (6) for stably restoring said at least one arm (4) in said first position (P1) at least when said centrifugal force no longer acts on said moveable arm.

17 Claims, 5 Drawing Sheets

(58) Field of Classification Search
USPC ..... 104/53, 75
See application file for complete search history.

(56) References Cited

U.S. PATENT DOCUMENTS

| | | | | |
|---|---|---|---|---|
| 1,877,256 | A * | 9/1932 | Siebert | A63G 1/48 472/1 |
| 5,115,744 | A * | 5/1992 | Barber | A63G 7/00 104/300 |
| 5,456,184 | A * | 10/1995 | Fritz | B62D 1/265 104/139 |
| 7,794,330 | B2 * | 9/2010 | Gordon | A63G 1/24 472/38 |
| 7,921,781 | B2 * | 4/2011 | Baker | A63G 7/00 104/60 |
| 8,065,963 | B2 * | 11/2011 | Groels | A63G 1/24 104/75 |
| 9,162,150 | B2 * | 10/2015 | Roodenburg | A63G 7/00 |
| 2003/0172834 | A1 | 9/2003 | De-Gol | |
| 2009/0013896 | A1 * | 1/2009 | Groels | A63G 1/24 104/75 |
| 2009/0124401 | A1 * | 5/2009 | Gordon | A63G 1/24 472/3 |

FOREIGN PATENT DOCUMENTS

| | | |
|---|---|---|
| EP | 1 944 069 | 7/2008 |
| EP | 2 175 951 | 4/2010 |
| WO | 91/13662 | 9/1991 |
| WO | 03/082421 | 10/2003 |

OTHER PUBLICATIONS

International Search Report, dated Nov. 27, 2014, issued in corresponding International Application No. PCT/EP2014/070058.
European Search Report, dated Dec. 3, 2013, issued in corresponding European Patent Application No. 13185304.

* cited by examiner

AMUSEMENT DEVICE

FIELD OF THE INVENTION

The present invention relates to an amusement device. In particular, the amusement device in question is used, for example, in funfairs and theme parks and, according to prior art, comprises a platform which moves along a track and which is also provided with an arm, which is rotatable constrained to the platform, and a compartment to accommodate passengers, which is integral with the arm. Such amusement devices are able to create an open experience for the passengers since the compartment for passengers may swing away from, and extend out over, the track.

BACKGROUND OF THE INVENTION

For example, US2003172834 by the applicant DE-GOL GINO et alii, describes a moving apparatus having a platform provided with a conventional industrial robot, particularly a robot with six inherent moving axes, with base, rocker, robot arm and robot hand carrying a passenger carrier provided with a frame and two seats. The robot is able to move in a controlled way the base, the rocker, the robot arm and the robot hand in order to move the passenger carrier in any direction of the space during the riding of the platform on the track.

This type of moving apparatus is extremely complex from a constructional point of view because of the presence of the robot and the fact that a personal computer has to be mounted onboard the platform to control the movements of the robot's components. Alternatively, an antenna has to be mounted on the platform to receive an external signal that controls the movements of the robot's components. Furthermore, the robot controls any movement of the passenger carrier, in particular during the turns along the track, thus making the experience for the passengers in some ways "piloted" and not completely "free".

WO03/082421, discloses a similar amusement ride wherein a vehicle is movable along a track. The vehicle that can be rotated about different rotation axes. The rotation is controlled by actuators such as electric motors, or pneumatic systems, thus limiting the experience for the passengers that is also in this case "piloted" and not completely "free".

The European patent EP2175951B1, in the name of Vekoma Rides, discloses a roller coaster for simulating a racing position on a motorbike. The passenger assembly includes a frame that is connected to a carriage and that is provided with a chest support, a back restraining member, and a leg restraining device for each leg. Additionally, the frame of the passenger assembly, and in particular the suspension arm, is suspended from the carriage by means of a pivot. The pivot axis is substantially directed longitudinally, i.e. substantially parallel with respect to the advance direction of passenger assembly along the roller coaster track. The passenger assembly will swing in pendulum fashion on a vertical plane as the carriage passes through a turn, that is to say when the frame is subjected to the centrifugal force. The above mentioned pendulum fashion is damped by means of two dampers arranged laterally to the suspension arm. When the centrifugal force no longer acts on the frame, that is to say when the carriage passes through a straight path, the frame returns to its initial vertical position being subjected to the gravitational force.

EP0115355 discloses a similar ride provided with a suspended carriage. The suspension is achieved by two support rods connected to each other by means of a shaft, extending along the movement direction of the ride. The suspended carriage can be rotated about the axis defined by the carriage movement direction.

Also in this case, the oscillating movement of the suspended carriage is damped by pneumatic or hydraulic damping cylinders, However, this last type of amusement rides are not without drawbacks. In fact, suspension arm could remain blocked in a tilted position in case the centrifugal force to which the suspension arm is subjected is excessively high, with consequents hazards for the passengers.

Therefore, there is the need to increase the safety of this kind of amusement devices, but at the same time to give to the passengers an open free experience, not piloted by any direct or active control.

SUMMARY OF THE INVENTION

The object of the present invention is to solve the problems described above.

A further object of the present invention is to produce such a type of amusement device which also ensures a high degree of safety.

Finally, another object of the present invention is to increase the experience of the passengers by giving them an open free experience, not piloted by any direct or active control on the moving arm and the passenger carrier.

These and other objects are achieved by the present amusement device comprising a platform riding on a track, preferably on the upper side of the track. In other words, the platform is supported by the track, on its upper side.

The track can comprise a single rail, or two parallel rails. Also a configuration with more than two rails can be provided.

According to a preferred embodiment, the track comprises two rails, and the platform is supported thereon. The platform is also provided with suitable means to allow the movement along the track, preferably comprising a plurality of rollers.

The platform is provided with at least one arm, moveably connected to said platform to rotate about a pivot of the platform, i.e. a pivot axis, from a first position to at least one second position, at least when a centrifugal force acts on said arm, and a compartment for housing one or more passengers preferably comprising one or more seats for the passengers, integral with or connected to said at least one moveable arm, characterized in that said platform comprises means for stably restoring said at least one arm in said first position at least when said centrifugal force no longer acts on said at least one moveable arm.

In practice, said restoring means are able to act on said arm in order to reposition it at its first position, or at the initial position, i.e. when the lateral forces no longer act on the arm, and to retain the arm in said first, or initial position. Therefore, the arm moves toward said at least one second position only under the action of the centrifugal force, i.e. when the platform pass through a turn of the track, or at least when the centrifugal force exceeds the force exerted by said restoring means on that arm.

In the following the movement of the arm, and in particular the rotation of the arm is disclosed as a "free" movement ("free" rotation). It has to be understood that the term "free" is used herein to indicate that the movement of the arm is caused by the centrifugal force, for example when the platform pass through a turn of the track, or at least when the centrifugal force exceeds the force exerted by said restoring means on the arm.

In other words, the term free is used to indicate that the moment of the arm is not caused by an actuator, or similar actuation means, and therefore the movement of the arm is not piloted by any direct, or active, control. According to an aspect of the invention said first position is a centered position and the at least one second position is an offset position.

Specifically, the first position for the arm is substantially in the middle of the platform, while said at least one second position for said arm is when said arm, or part of them, swings way from, and extends out over, the track. In this second position also the passenger compartment swings way from, and extends out over, the track. According to an aspect of the invention, when the movable arm is in the first position, it is parallel, or coincident, with the advance direction of the platform along the track. More in detail, the arm preferably has a longitudinal axis of extension, the axis of the arm being parallel, or coincident, with the advance direction of the platform along the track when the movable arm is in the first position.

In the first position, the arm is not subjected to a centrifugal force and it is parallel, or coincident, with the advance direction of the platform along a straight portion of the track.

Therefore, the arm moves (rotates) only under the action of a centrifugal force, i.e. when the platform pass through a turn of the track, reaching one of the two second positions, or at least moving towards one of the two second positions. It has to be noted that the track of the amusement ride can be provided with a plurality of turns, and straight sections, according to different possible design, depending on the experience to be provided to the passengers.

According to an embodiment of the invention, said at least one arm freely rotates with respect to said platform about a pivot axis. In particular, said platform further comprises a vertical pivot, i.e. a vertical pivot axis, such that said arm rotates about said vertical pivot on a substantially horizontal plane. It has to be noted that the rotation pivot of the arm can be a substantially vertical pivot, i.e. a substantially vertical pivot axis, such that said arm rotates on a substantially horizontal plane.

In other words, the pivot axis is directed substantially perpendicularly with respect to the platform. With reference to the track, the substantially vertical pivot axis, is substantially perpendicularly with respect to the advance direction of the platform along the track.

Therefore, the arm is rotated on a substantially horizontal plane that is substantially parallel to the platform.

The term "substantially" means that the pivot axis can be slightly inclined with respect to the vertical condition (for example of an angle lower than 30°, preferably lower than 20°), so that the arm can rotate on a horizontal plane that can be slightly inclined with respect to the platform.

According to a possible embodiment, the amusement device comprises one arm having a first end that is freely rotatable connected to the pivot and a second free end that carries said compartment provided with a frame and one or more seats. Specifically, said compartment is rotatably constrained to said arm.

According to another possible embodiment, the amusement device comprises two movable arms connected to said platform and the passengers compartment is connected to said two movable arms by means of a third arm, thus forming a four-bar linkage (i.e. an articulated quadrilateral linkage).

According to an aspect of the present invention, the compartment for the passengers is arranged in front of the pivot about which the at least one arm rotates. It has to be understood that the expression "in front of" is used herein to indicate that the passengers compartment, and thus one or more seats, are arranged in front of the pivot axis, about which the arm rotates, with respect to the advance direction of the platform on the track.

By doing so, when the arm rotates the compartment for housing at least one passenger overhangs the track thus increasing the passenger's fun.

Furthermore, according to a particular aspect of the invention said at least one arm freely rotates with respect to said platform from a first position to two second positions, at least when a centrifugal force acts on said arm, wherein said first position is arranged between said two second positions. In particular, said arm reaches said two second positions after, respectively, a clockwise or counterclockwise rotation with respect to said first position, or initial position. Said first position is therefore arranged between said two second positions.

Furthermore, said restoring means are of the passive type. This means that said restoring means are not electrically feed or controlled by a personal computer, thus there is no active or dynamic control acting on the arm contrary to what disclosed, for example, in US2003172834. This solution allows to make simpler the manufacturing, assembly and maintenance of the amusement device according to the invention.

Preferably, said platform comprises means for limiting the free movement, or rotation, of said at least one arm. Said limiting means comprise at least one travel stop arranged along the path of said arm to limit the free movement, or rotation, of said arm at said at least one second position.

According to a specific embodiment of the invention, said restoring means comprise at least one ramp raising between said first position and said at least one second position for said arm, and at least one variable-length leg sliding along said at least one ramp, at least when a centrifugal force acts on said arm.

The expression "raising between said first position and said at least one second position" is used herein to indicate that the ramp modifies its height along its extension. According to the invention, the height of the ramp is increased at least between said first position of the movable arm and said at least one second position of the movable arm.

By doing so, when the at least one arm rotates, the distance between said arm and said platform is kept constant because the movement of the arm is substantially parallel to the platform, while the leg needs to modify its length during the sliding along the ramp. In fact, as above mentioned, the ramp changes its height along its extension and preferably the ramp raises from the first position to the at least one second position thus modifying its distance with the arm along its extension.

It has to be noted that the expression "variable-length leg" is used herein to indicate any suitable element able to modify its length when sliding along said ramp during the movement of said at least one arm. The modification of the length is able to exert a lateral centering (restoring) force intended to return said at least one movable arm in said first position when the centrifugal force no longer acts.

The at least one ramp is preferably arranged on said platform and said at least one variable-length leg is integral with said arm, however the ramp can be provided on, or connected to the arm and the variable-length leg can be provided on, or connected to the platform, according to different possible embodiments.

According to a preferred embodiment two ramps, each of which raising between said first position and said at least one second position, can be provided. It has to be noted that the two ramps are arranged having their lowest portion (minimum height) in common or arranged one next to the other. Thus, said first position substantially corresponds to the lowest portions of said ramps.

In particular, said variable-length leg is an axially sliding leg and said at least one ramp is, at least in part, circular-shaped.

Advantageously, said variable-length leg comprises at least one wheel arranged at the free end of said variable-length leg and rotatable on said at least one ramp. Again, said variable-length leg comprises at least one spring acting in compression, directly or indirectly, between said arm and said wheel, or other suitable elastic means between said arm and said wheel.

In accordance with a further embodiment of the invention, said restoring means comprise at least one spring arranged, directly or indirectly, between said arm and said at least one travel stop.

DESCRIPTION OF THE FIGURES

One or more particular embodiments of the present invention are now described in greater detail with reference to the accompanying drawings provided by way of non-limiting example, wherein.

Figure 1:
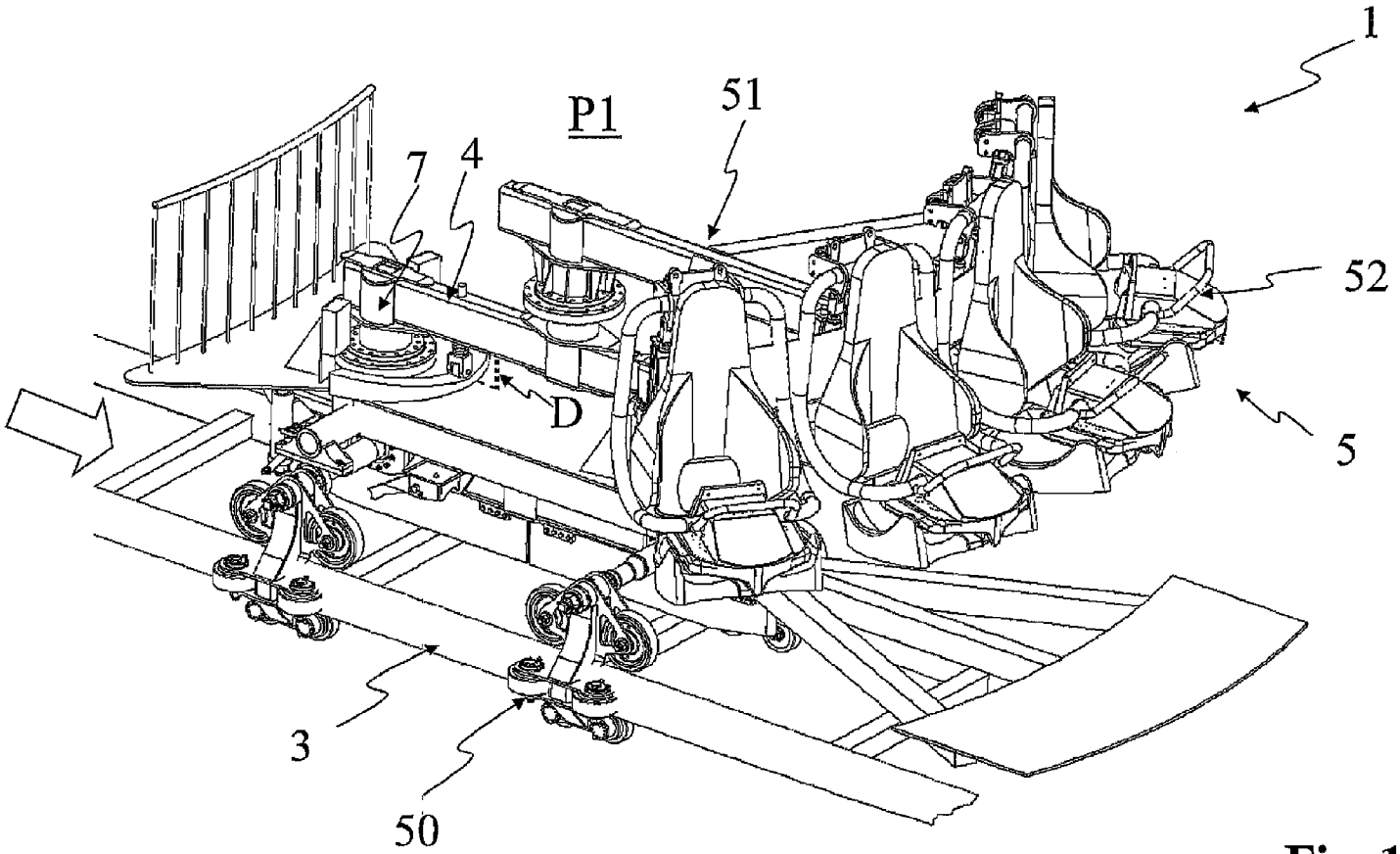
FIG. 1 is a perspective view of the amusement device according to the invention when the arm is in its initial position.

With reference to these figures, the generic amusement device according to the invention is indicated with 1.

DETAILED DESCRIPTION OF THE INVENTION

With reference to figures from 1 to 3, the amusement device 1 comprises a platform 2 riding on a track 3, preferably on the upper side of the track, by means of a plurality of rollers 50.

According to a preferred embodiment, the track comprises two rails and the platform 2 is supported thereon.

Said platform 2 is provided with at least one arm 4, which is moveably connected to said platform 2, from a first position P1 to two second positions P2, at least when a centrifugal force acts on said arm 4, and a compartment 5 for housing a plurality of passengers. The at least one arm 4 rotates about a pivot 7, i.e. pivot axis, with respect to the platform 2.

Figure 2:
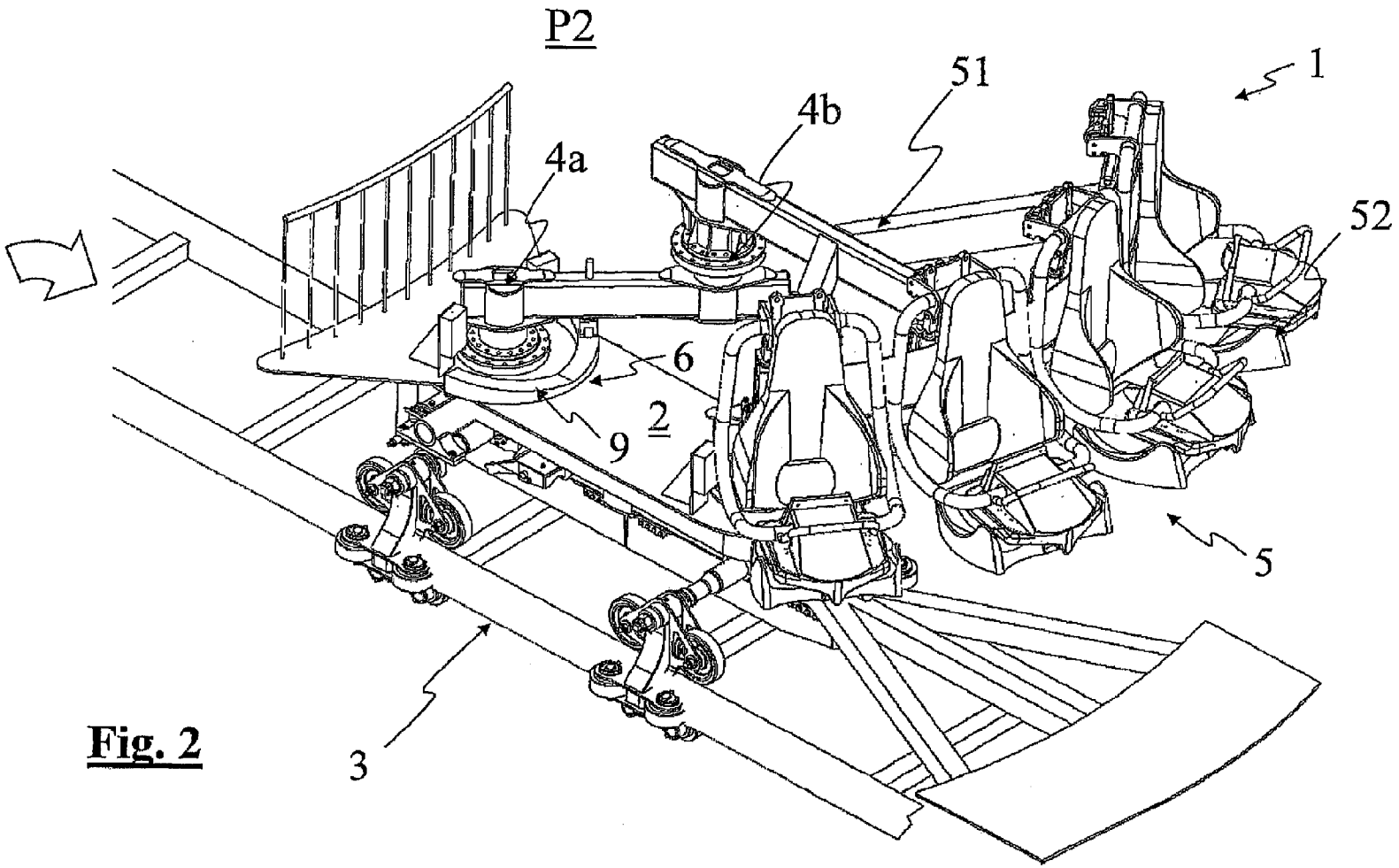
FIG. 2 is a perspective view of the amusement device of FIG. 1 when the arm is in its lateral position.
Figure 2A:
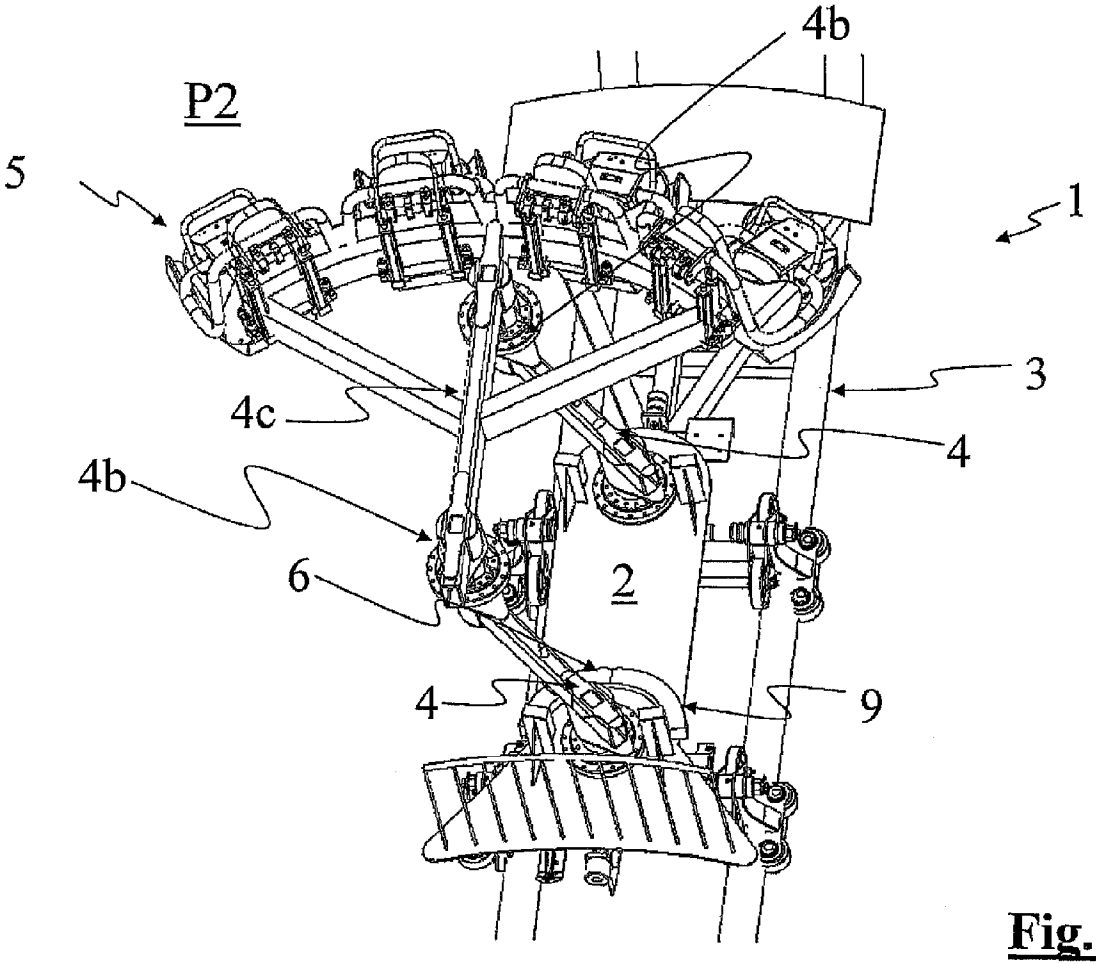
FIG. 2A is another perspective view of the amusement device of FIG. 1 when the arm is in its lateral position.
Figure 3:
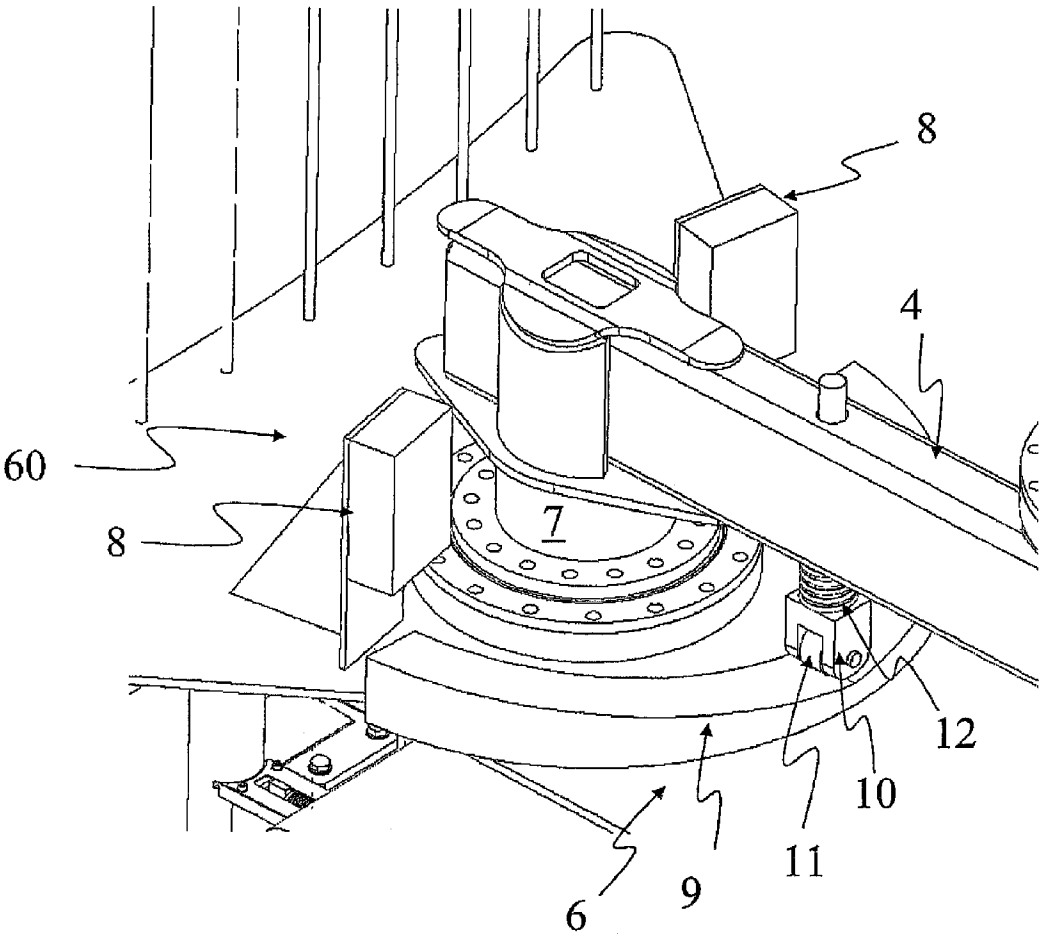
FIG. 3 is a particular of the restoring device of the amusement device of FIG. 1.

As better shown in FIG. 2A the embodiment shown in FIGS. 1-3 is provided with two arms 4 movably connected to the platform 2 and the compartment 5 for housing the passenger is connected to the two movable arms 4 by means of a third arm 4*c*, thus forming a four-bar linkage (see FIG. 2A).

However, the amusement device according to the invention can provided with a different number of movable arm 4. As it will be disclosed later in connection to FIG. 4, according to a possible embodiment the amusement device can be provided with a single movable arm 4 connected to the platform 2. Also in this case, the movable arm 4 rotates with respect to the platform about a pivot 7.

Said compartment 5 is rotatably constrained to the arm 4 and is provided with a frame 51 and a plurality of seats 52 for the passengers.

The compartment for the passengers is preferably arranged in front of the pivot about which the arm 4 rotates. More in details, at least one seat 52 of the compartment 5 is arranged in front of the pivot 7 about which the arm 4 rotates.

Advantageously, said platform 2 comprises means 6 for stably restoring said moveable arm 4 in its first position P1, starting from one of two second positions P2, when said centrifugal force no longer acts on said freely moving arm 4.

In the embodiment shown in FIGS. 1-3, only one of said two movable arms 4 connected to the platform 2 comprises restoring means 6. However, according to a possible embodiment, both movable arms 4 can be provided with restoring means 6.

Additionally, in the following, reference will be made only to an arm 4 of the embodiment shown in FIGS. 1-3 because in the four-bar linkage of this embodiment the two movable arms 4 connected to the platform 2 are linked one to another.

According to the particular embodiment hereinafter disclosed, the moveable arm 4 is arranged in the middle of the platform 5 in its first position P1, or initial position, i.e. when it is not still subjected to a centrifugal force or when the centrifugal force is less than the force exerted by said restoring means, while the moveable arm 4 is arranged laterally to the first position P1 in its two second positions P2, respectively, at right or left of the first position P1, after the arm has been subjected to a centrifugal, or at least when the centrifugal force is less than the force exerted by said restoring means on that arm.

In practice, said restoring means 6 are able to act on said arm 4 in order to reposition the same arm 4 at its first position P1, that is to say at the position in which the lateral forces no longer act on the arm. Furthermore, said restoring means 6 are also able to retain the arm in said first position P1, remaining in a substantially stable position, if the centrifugal force does not exceed the force exerted by the restoring means 6 on said arm 4. Therefore, the arm 4 moves only under the action of a centrifugal force, i.e. when the platform 2 pass through a turn of the track 3, reaching one of the two second positions P2, while it returns to its first position P1 when it is no longer subjected to the centrifugal force, i.e. when the platform 2 rides along a straight section of the track 3. Specifically, the arm 4 and the compartment 2 are positioned in the middle of the platform 2 and parallel to the direction of the same platform 2, when the platform 2 passes through a straight section of the track 3. On the contrary, the arm 4 and the compartment 2, or part of them, swing way from, and extend out over, the track 3 when the platform 2 passes through a turn of the track 3.

In this case, based on the direction of the turn, left or right, the arm 4 will move from the first position P1 to one of the two second positions P2, arranged in such a way that said first position P1 is arranged between said two second positions P2.

Preferably, the compartment 5 for housing the passengers is arranged in front of the pivot about which the at least one movable arm 4 rotates with respect to the platform 2, thus during a turn the passengers overhang the track.

It should be noted that although the above mentioned embodiment discloses a solution in which the arm is moveable between a first position and two second positions, yet a solution that discloses an arm that is moveable between a first position and only one second position falls within the scope of protection of the present invention.

According to the embodiment disclosed in FIGS. 1-3, said two arms 4 rotate with respect to said platform 2 (see in particular FIG. 2A). In particular, said platform 2 further comprises a vertical pivot 7 such that the arm 4 may rotates about said vertical pivot 7 on a substantially horizontal plane between the first position P1 and the two second positions P2. In particular, the arm 4 rotates with respect to said platform 2 from a first position P1 to two second positions P2, at least when a centrifugal force acts on said arm 4, wherein said first position P1 is arranged between said two second positions P2. Said arm 4 reaches said two second positions P2 after, respectively, a clockwise or counterclockwise rotation with respect to said first position P1, or initial position. Said first position P1, as disclosed above, is therefore arranged between said two second positions P2.

As already mentioned above, the embodiment shown in FIGS. 1-3 comprises two movable arms 4. Each of said arms 4 comprises a first end 4*a* that is freely rotatable connected to said vertical pivot 7 and a second free end 4*b* that is connected to said compartment 5 provided with a frame 51 and a plurality of seats 52 for the passengers. More in detail, the compartment 5 is connected to the arms 4 by means of a third arm 4*c* connected to the second free ends 4*b* of said movable arms 4 (see FIG. 2A).

Although the above mentioned embodiment discloses a solution in which the arm rotates about a pivot, yet a solution that discloses an arm that laterally slides, or translates, along the platform from a first position to two second positions, arranged on opposite sides with respect to said first position, still falls within the scope of protection of the present invention.

The restoring means 6 are of the passive type therefore there is no active or dynamic control on the arm 4, that is to say by means of a computer or the like, thus said arm is freely rotating about the pivot 7.

Furthermore, said platform 2 comprises means 8 for limiting the free rotation of said arm 4. Said limiting means 8 comprise two travel stops 60 arranged along the path of said arm 4 to limit the free rotation of said arm 4 in said two positions P2. In particular, the two travel stops 8 are arranged in such a way that the pivot 7 is interposed between them. The arm 4 is thus able to rotate about the pivot 7 for a total of 150° degrees wherein the first position P1 for the arm 4 is at 75° degrees. Although the above mentioned embodiment discloses a solution in which the arm is able to rotate about the pivot for 150° degrees, yet a solution that discloses an arm that is able to rotate about a pivot for an angle different from 150° degrees, such as 100° degrees or 200° degrees or for substantially 360 degrees, falls within the scope of protection of the present invention. According to the embodiment disclosed in FIGS. 1-3, said restoring means 6 comprise at least one ramp 9 raising between said first position P1 and said at least one second position P2 for the at least one arm 4, and at least one variable-length leg 10 sliding along the at least one ramp 9 at least when a centrifugal force acts on the arm 4.

Even if in FIGS. 1, 2 and 3 the restoring means 6 are provided only for one of the two movable arms 4, according to a possible embodiment also the other arm 4 can be provided with restoring means 6.

According to a possible embodiment, two ramps 9 are provided, preferably arranged on said platform 2, on opposite parts with respect to the pivot 7, and rising in opposed directions from the first position P1 to the two respective second positions P2. Therefore, the minimum height of the two ramps is in correspondence of the first position P1.

Obviously, only one continuous ramp 9 can be shaped so as to comprise a minimum height in correspondence of the first position P1 of the arm 4 and raising by extending in opposed directions from the first position P1 to the two respective second positions P2.

Said restoring means 6 further comprise a variable-length leg 10, preferably integral with said arm 4, and sliding along said ramps 9 at least when a centrifugal force acts on said arm 4 such that the distance D between said arm 4 and said platform 2 is kept constant during the rotation of said arm 4.

In fact, when the movable arm 4 rotates under the action of the centrifugal force it keeps parallel to the platform 2 while the variable-length leg 10 slides along the ramp 9 and modifies its length during the movement along the ramp 9.

In particular, said variable-length leg 10 is an axially sliding leg. Furthermore each ramp 9 has a partial circular shape in order to allow the leg 10 to slide along a circular path when the arm 4 rotates.

It has to be noted that according to different possible embodiments the extension of the ramp 9 can be modified according to the movement of the arm 4, and in particular to its angular movement.

As already mentioned above, in the embodiment shown in the figures, the arm 4 rotates of an angle equal to 150° degrees, however a solution that discloses an arm that is able to rotate about a pivot for an angle different from 150° degrees, such as 100° degrees or 200° degrees or for substantially 360 degrees, can be provided. In the embodiment shown in the figures each ramp 9 extends on a circular path and has an angular extension of about 75 degrees.

According to a possible embodiment not shown in the figures, the arm 4 can be rotatable about the pivot 7 of substantially 360 degrees, i.e. 180 degrees from the first position P1 to the second potion P2 for both a clockwise rotation and a counterclockwise rotation. In this embodiment each ramp extends substantially for 180 degrees along a circular path.

As it is shown in particular in FIG. 3, each ramp 9 rises from the first position P1 to the respective second position P2. In this way, whatever is the rotation of the arm 4, clockwise or counterclockwise, the restoring means 6 are able to reposition the arm 4 in its first position P1, i.e. in the middle of the platform 2, at least when a centrifugal force no longer acts on said arm 4.

Still according to the embodiment of the invention, said variable-length leg 10 comprises at least one wheel 11 arranged at the free end 10*a* of said variable-length leg 10 and rotatable on said ramp 9. Said variable-length leg 11 further comprises a preloaded spring 12 acting in compression between said arm 9 and said wheel 11 thus a centering force (restoring force) of the arm 4 can be exerted when the spring 12 is compressed due to the sliding movement of the variable-length leg 10 along the ramp 9. Such a solution allows to guarantee a sufficient and rapid reposition of the variable length leg 10 as the position of the moveable arm 4 varies, in particular when the arm moves form one of the two second positions P2 to the first position P1. In functioning, if the platform 2 rides along a straight section of the track 3 the arm 4 maintains its central position (see FIG. 1), or first position P1. In particular, the arm 4 maintains parallel to the direction of the platform 2, being not subjected to a centrifugal or lateral force. In FIG. 2, the platform 2 has just terminated a turn and it is still in one of the two second positions P2 because of the centrifugal force previously acting on same arm 4. The restoring means 6 will immediately reposition the arm 4 to the first position P1, i.e. in the middle of the platform 2, as shown in FIG. 1. In particular the leg 10, by means of the wheel 11, will slide down along the ramp 9 toward the first position P1 and, after a few oscillations in the region of the first position P1, it will stop there.

Figure 4:
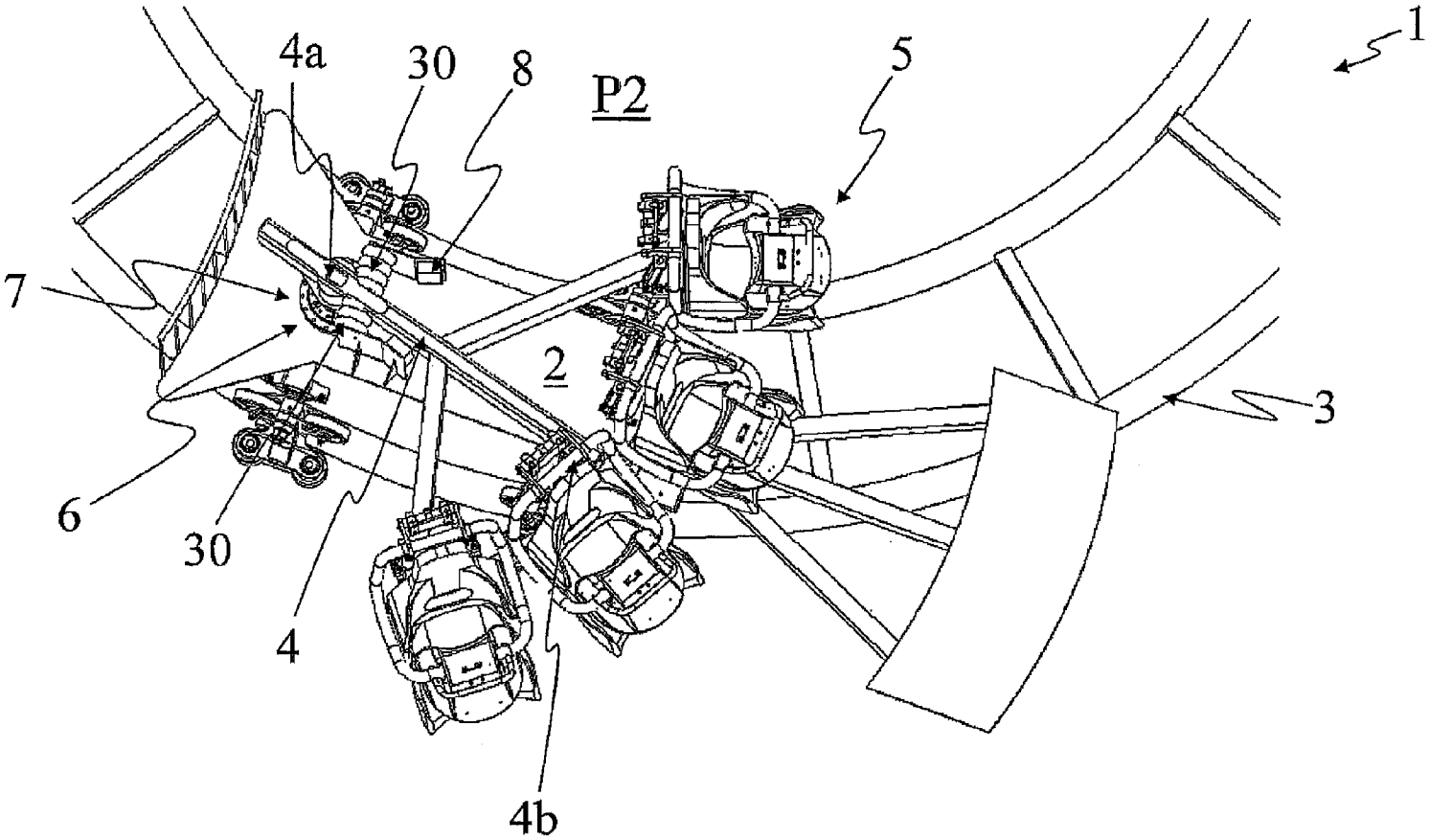
FIG. 4 is a perspective view of the amusement device according to another embodiment of the invention.

Finally, according to an alternative solution shown in FIG. 4, in place of the ramps 9 and the variable-length leg 10 said restoring means 6 comprise two preloaded springs 30, or other suitable restoring means such as for example airbags, arranged in such a way that the arm 4 is interposed between said preloaded springs 30.

Furthermore each preloaded spring 30 is positioned between its respective travel stop 8 and the arm 4. In this way during a turn the moveable arm 4 is moved by the centrifugal force in direction of one of the two travel stops 8, thus compressing one of the two springs 30 arranged between one of said two travel stops 8 and the arm 4 and elongating the other spring arranged between the other travel stop and the arm 4.

When the platform 2 overcomes the turn, the platform is no longer subjected to a centrifugal force, thus the springs 30 restore the first position P1 of the arm 4 after a few oscillations of the arm 4 in the region of the same first position P1.

It has to be noted that the embodiment of the amusement device shown in FIG. 4 also differs from the embodiment shown in FIGS. 1-3, in that it comprises a single movable arm 4 connected to the platform 2 instead of a four-bar linkage (as shown in FIGS. 1-3). In the embodiment shown in FIG. 4, the arm 4 comprises a first end 4*a* that is freely rotatable connected to a vertical pivot 7 and a second free end 4*b* that carries said compartment 5 provided with a frame 51 and a plurality of seats 52 for the passengers.

It has to be noted that the restoring means 6 shown in FIGS. 4, comprising springs 30, or other suitable restoring means such as airbags, can be used in the embodiment shown in FIGS. 1-3.

Obviously, also the restoring means 6 of the embodiment shown in FIGS. 1-3, comprising at least one ramp 9 and at least one variable-length leg 10, can be used in the embodiment shown in FIG. 4 wherein a single movable arm 4 is provided.

The invention claimed is:

1. An amusement ride, comprising:

a track;

a platform ridable on the track, the platform including at least one arm, moveably connected to the platform, to rotate about a pivot with respect to the platform, from a first position to at least one second position, at least when a centrifugal force acts on the arm; and a compartment comprising one or more seats adapted to house at least one passenger, integral with or connected to the arm;

wherein the platform includes a restoring device adapted to stably restore the arm in the first position at least when the centrifugal force no longer acts on the arm, wherein the pivot is substantially vertical, and the arm is rotatable about the vertical pivot in a substantially horizontal plane, and wherein the compartment is distanced from the pivot about which the arm rotates, and the compartment and the seats for housing one or more passengers are arranged in front of the pivot about which the at least one arm rotates, with respect to the advance direction of the platform along the track.

2. The amusement ride according to claim 1, wherein the compartment is integral with or connected to a free end of the arm.

3. The amusement ride according to claim 1, wherein the platform is supported on an upper side of the track.

4. The amusement ride according to claim 1, wherein the restoring device is passive.

5. The amusement ride according to claim 1, wherein the platform includes a limit device adapted to limit rotation of the arm at the second position.

6. The amusement ride according to claim 5, wherein the limit device includes at least one travel stop arranged along a path of the arm to limit the rotation of the arm.

7. The amusement ride according to claim 1, wherein the restoring device includes at least one spring arranged, directly or indirectly, between the arm and at least one travel stop.

8. The amusement ride according to claim 1, wherein the compartment is rotatably constrained to the arm.

9. The amusement ride according to claim 1, wherein the first position is located substantially in a middle of the platform.

10. The amusement ride according to claim 1, wherein in the first position, the arm is arranged parallel, or coincident, to an advance direction of the platform along the track.

11. The amusement ride according to claim 1, wherein a distance between the arm and the platform is kept constant during rotation of the arm.

12. The amusement ride according to claim 1, wherein the arm is moveably connected to the platform from the first position to two second positions, at least when a centrifugal force acts on the arm, the first position being arranged between the two second positions.

13. An amusement ride, comprising:

a track;

a platform ridable on the track, the platform including at least one arm, moveably connected to the platform, to rotate about a pivot with respect to the platform, from a first position to at least one second position, at least when a centrifugal force acts on the arm; and a compartment adapted to house at least one passenger, integral with or connected to the arm;

wherein the platform includes a restoring device adapted to stably restore the arm in the first position at least when the centrifugal force no longer acts on the arm; and wherein the restoring device includes at least one ramp raising between the first position and the second position for the arm, and at least one variable-length leg slidable along the ramp at least when a centrifugal force acts on the arm.

14. The amusement ride according to claim 13, wherein the variable-length leg includes an axially sliding leg.

15. The amusement ride according to claim 13, wherein the ramp is at least in part circular-shaped.

16. The amusement ride according to claim 13, further comprising a wheel arranged at a free end of the variable-length leg and rotatable on the ramp.

17. The amusement ride according to claim 16, further comprising a spring, acting in compression, directly or indirectly, between the arm and the wheel.

* * * * *